US008731434B2

(12) United States Patent
Okabe

(10) Patent No.: US 8,731,434 B2
(45) Date of Patent: May 20, 2014

(54) IMAGE-FORMING DEVICE HAVING GUIDING PARTS FORMED AT OPEN/CLOSE MEMBER TO GUIDE DRAWER MEMBER

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 89 days.

(21) Appl. No.: 13/423,378

(22) Filed: Mar. 19, 2012

(65) Prior Publication Data

US 2013/0004200 A1 Jan. 3, 2013

(30) Foreign Application Priority Data

Jun. 30, 2011 (JP) ..... 2011-145167

(51) Int. Cl.
*G03G 15/01* (2006.01)
*G03G 21/18* (2006.01)

(52) U.S. Cl.
USPC ..... 399/110; 399/112

(58) Field of Classification Search
USPC ..... 399/110, 112, 111, 124, 125
See application file for complete search history.

(56) References Cited

U.S. PATENT DOCUMENTS

| | | | | |
|---|---|---|---|---|
| 7,359,656 | B2 * | 4/2008 | Song | 399/110 |
| 7,773,905 | B2 | 8/2010 | Kuruma | |
| 7,907,868 | B2 | 3/2011 | Igarashi et al. | |
| 8,036,572 | B2 | 10/2011 | Maeda | |
| 8,204,405 | B2 | 6/2012 | Mushika et al. | |
| 8,554,110 | B2 | 10/2013 | Mushika et al. | |
| 2003/0053819 | A1 * | 3/2003 | Nomura et al. | 399/110 |
| 2005/0207783 | A1 * | 9/2005 | Sugimura et al. | 399/111 |
| 2006/0251446 | A1 | 11/2006 | Okabe et al. | |
| 2007/0071494 | A1 | 3/2007 | Igarashi et al. | |
| 2008/0279579 | A1 | 11/2008 | Kuruma | |
| 2009/0324283 | A1 | 12/2009 | Mushika et al. | |
| 2010/0080618 | A1 * | 4/2010 | Suzuki | 399/112 |
| 2010/0202803 | A1 | 8/2010 | Sato et al. | |
| 2010/0239313 | A1 * | 9/2010 | Maeda | 399/112 |
| 2012/0027455 | A1 * | 2/2012 | Kato | 399/110 |
| 2012/0070185 | A1 * | 3/2012 | Yokota | 399/110 |
| 2012/0251173 | A1 | 10/2012 | Mushika et al. | |

FOREIGN PATENT DOCUMENTS

| | | | |
|---|---|---|---|
| CN | 1755555 | A | 4/2006 |
| CN | 101303565 | A | 11/2008 |
| CN | 101620405 | A | 1/2010 |
| CN | 101833272 | A | 9/2010 |

(Continued)

OTHER PUBLICATIONS

CN Office Action mailed Nov. 4, 2013, CN Appln. 201210086683.8, English translation.

*Primary Examiner* — Sophia S Chen
(74) *Attorney, Agent, or Firm* — Banner & Witcoff, Ltd.

(57) ABSTRACT

An image-forming device includes: a main casing defining an accommodating space therein; an open/close member provided at the main casing to move between an open position and a closed position, the open/close member positioned in the open position extending in a direction; a drawer member configured to be supportable a plurality of cartridges and movable from an accommodated position to a withdrawn position along the open/close member positioned in the open position, the plurality of cartridges being accommodated in the accommodating space when the drawer member is positioned in the accommodated position, the plurality of cartridges being exposed from the main casing when the drawer member is positioned in the withdrawn position. The open/close member positioned in the open position has a length in the direction. A guiding part is formed at the open/close member over the length to guide the drawer member to the withdrawn position.

10 Claims, 8 Drawing Sheets

1

(56) References Cited

FOREIGN PATENT DOCUMENTS

| | | |
|---|---|---|
| JP | 2003-345220 | 12/2003 |
| JP | 2006-276726 | 10/2006 |
| JP | 2007-121983 | 5/2007 |
| JP | 2008-158548 | 7/2008 |
| JP | 2010224061 A | 10/2010 |

* cited by examiner

IMAGE-FORMING DEVICE HAVING GUIDING PARTS FORMED AT OPEN/CLOSE MEMBER TO GUIDE DRAWER MEMBER

CROSS REFERENCE TO RELATED APPLICATION

This application claims priority from Japanese Patent Application No. 2011-145167 filed Jun. 30, 2011. The entire content of this application is incorporated herein by reference.

TECHNICAL FIELD

The present invention relates to an image-forming device employing an electrophotographic system.

BACKGROUND

One type of electrophotographic color printer known in the art is a color laser printer that includes a device body, and a process unit that can be detachably mounted in the device body for retaining a plurality of developer cartridges.

One such color laser printer includes a main casing provided with guiding walls, and a process unit that can be mounted into and pulled out of the main casing while being guided by the guiding walls. The process unit functions to detachably support a plurality of developer cartridges.

Hence, when performing an operation to replace developer cartridges in the laser printer described above, the process unit is pulled out from the main casing in order to remove the developer cartridges from the process unit and to replace them with new developer cartridges. When the process unit is pulled out from the main casing, supported parts provided on the upstream end of the process unit with respect to the pulling direction are guided along the guiding walls of the main casing. After pulling the process unit out from the main casing, the supported parts continue to be supported by the guiding walls so that the process unit is maintained in a withdrawn state.

SUMMARY

However, in the conventional laser printer described above, only the supported parts provided on the upstream end of the process unit in the pulling direction are guided along the guiding walls within the main casing. The downstream end of the process unit in the pulling direction is not directly guided at this time. Therefore, the process unit may become unstable while being pulled out from the main casing and may have too much play when being guided out of the main casing and when in the withdrawn state.

In view of the foregoing, it is an object of the present invention to provide an image-forming device having a simple construction while being capable of improving operability for pulling a drawer member from a device body.

In order to attain the above and other objects, the invention provides an image-forming device includes: a main casing defining an accommodating space therein, and formed with an access opening communicating the accommodating space with an exterior; an open/close member provided at the main casing to move between an open position for opening the access opening and a closed position for closing the access opening, the open/close member positioned in the open position extending in a direction; and a drawer member configured to be supportable a plurality of cartridges and movable from an accommodated position to a withdrawn position along the open/close member positioned in the open position, the plurality of cartridges being accommodated in the accommodating space when the drawer member is positioned in the accommodated position, the plurality of process cartridges being exposed from the main casing when the drawer member is positioned in the withdrawn position. The opening/closing member positioned in the open position has a length in the direction. A guiding part is formed at the open/close member over the length to guide the drawer member to the withdrawn position.

It is preferable that the open/close member positioned in the open position is positioned beneath the drawer member positioned in the withdrawn position.

It is preferable that the guiding part has a first guiding part formed on the open/close member positioned in the open position and extending in the direction.

It is preferable that the open/close member has both edges extending in the direction, and the guiding part further has a pair of second guiding parts to guide the both edges.

It is preferable that the open/close member includes a restricting part configured to restrict the drawer member from moving to a downstream of the drawer position in the direction.

It is preferable that the guiding portion is sloped downward when the open/close member is positioned in the open position.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

1. Overall Structure of a Color Printer

Figure 1:
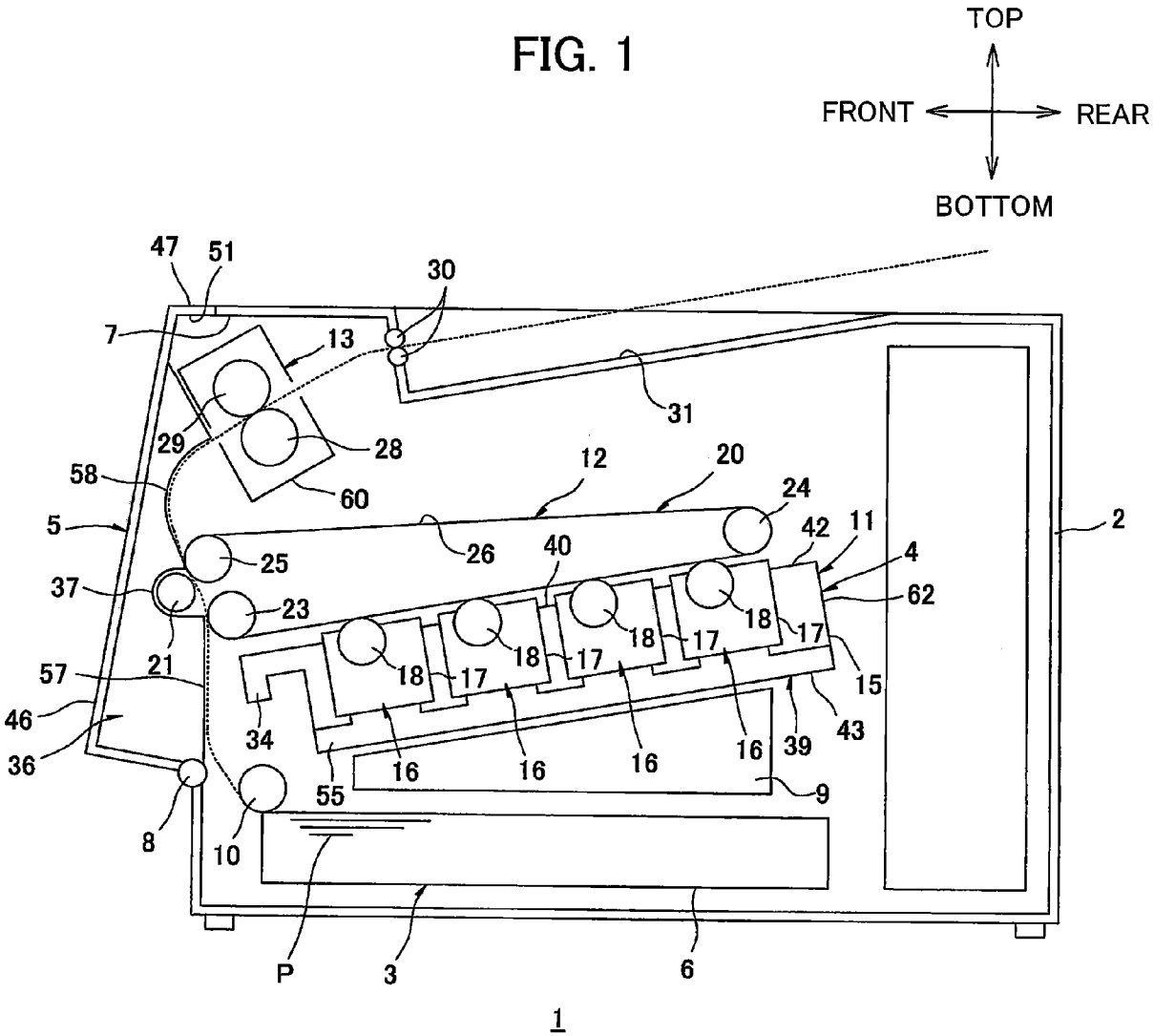
FIG. 1 is a lateral cross-sectional view of a color printer serving as an example of the image-forming device according to a first embodiment of the present invention.

FIG. 1 shows a color printer 1 serving as an example of the image-forming device of the present invention. The color printer 1 is a horizontal tandem-type intermediate transfer color printer.

The color printer 1 includes a main casing 2 constituting the device body, a sheet-feeding unit 3 for feeding sheets of a paper P accommodated in the main casing 2 to be printed, and an image-forming unit 4 for forming images on the paper P supplied by the sheet-feeding unit 3.

(1) Main Casing

The main casing 2 is box-shaped and substantially rectangular in a side view. An access opening 7 is formed in a side wall of the main casing 2. A front cover 5 is pivotably (movably) provided on the same side of the main casing 2. The front cover 5 is generally C-shaped in a side view. Two hinge parts 8 are provided on the lower edge of the front cover 5. The front cover 5 can pivot about the hinge parts 8 between an open position for exposing the access opening 7, and a closed position for covering the access opening 7.

In the following description, the side of the main casing 2 on which the front cover 5 is provided (the left side in FIG. 1) will be called the "front side," and the opposite side (the right side in FIG. 1) will be called the "rear side." Further, the left and right sides of the main casing 2 will be based on the perspective of a user facing the front side of the color printer 1. In other words, the near side in FIG. 1 will be the "right side," while the far side will be the "left side."

(2) Sheet-Feeding Unit

The sheet-feeding unit 3 includes a paper tray 6 for accommodating sheets of paper P. The paper tray 6 is removably mounted in the bottom section of the main casing 2. The sheet-feeding unit 3 is provided with a feeding roller 10 disposed above the front end of the paper tray 6.

The feeding roller 10 rotates to feed sheets of paper P from the paper tray 6 along a path indicated by a dotted line in FIG. 1. Registration rollers (not shown) disposed along this path rotate to supply the sheets to the image-forming unit 4 (between an intermediate transfer belt 26 and a secondary transfer roller 21, both described later) at a prescribed timing.

(3) Image-Forming Unit

The image-forming unit 4 is disposed above the sheet-feeding unit 3 and includes a scanning unit 9, a process unit 11, a transfer unit 12, a fixing unit 13, and a paper-guiding section 36.

(3-1) Scanning Unit

The scanning unit 9 is disposed above the paper tray 6. The scanning unit 9 functions to expose four photosensitive drums 18 described later by irradiating laser beams toward the respective photosensitive drums 18 based on image data.

(3-2) Process Unit

The process unit 11 is disposed above the scanning unit 9 and slopes downward toward the front. The process unit 11 includes a process frame 15 serving as an example of the drawer member of the present invention, and process cartridges 16.

Figure 4:
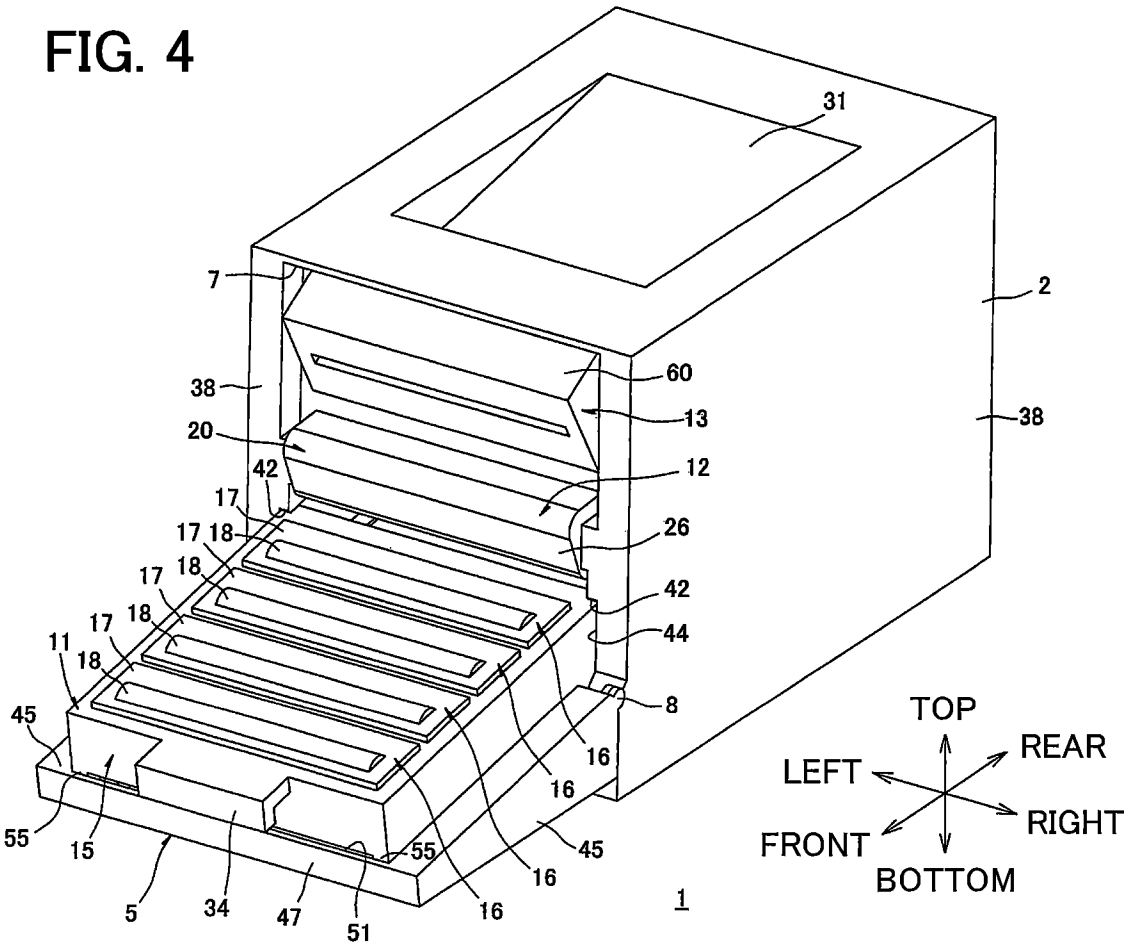
FIG. 4 is a cross-sectional view of the color printer according to the first embodiment of the present invention showing the process unit in the withdrawn position.

The process frame 15 has a frame-like structure that is generally rectangular in a plan view and elongated in the front-to-rear direction (see FIG. 4). The process frame 15 is provided in an accommodating space 40 (described later) in the main casing 2 and can be pulled out therefrom. The process frame 15 includes a handle 34, and guided parts 55.

The handle 34 is disposed on the front surface of the process frame 15 in the left-to-right center region thereof. The handle 34 extends forward from the front surface, then bends downward so as to describe a general L-shape in a side view.

The guided parts 55 are provided on the bottom surface of the process frame 15, with one on each of the left and right edges thereof. The guided parts 55 are generally rectangular in a front view (see FIG. 2) and are elongated in the front-to-rear direction. The guided parts 55 protrude downward from the bottom surface of the process frame 15.

The process unit 11 is provided with four process cartridges 16 corresponding to the four colors used in image formation. The process cartridges 16 are detachably supported in the process frame 15 and are arranged parallel to one another at intervals in the front-to-rear direction.

Each of the process cartridges 16 is provided with a cartridge frame 17, a photosensitive drum 18, and a developer cartridge (not shown).

The cartridge frames 17 are box-shaped and generally rectangular in a side view.

The photosensitive drums 18 are generally cylindrical in shape and are oriented with their axes aligned in the left-to-right direction. Each photosensitive drum 18 is rotatably supported in the corresponding cartridge frame 17 so that the top peripheral surface of the photosensitive drum 18 is exposed above the top edge of the cartridge frame 17.

The developer cartridges (not shown) are generally hollow members with an interior space for accommodating toner of a corresponding color. Each developer cartridge is provided with a developing roller (not shown). The developer cartridge is detachably retained in the corresponding cartridge frame 17. When the developer cartridge is mounted in the cartridge frame 17, the developing roller contacts the peripheral surface of the photosensitive drum 18.

(3-3) Transfer Unit

The transfer unit 12 is positioned above the process unit 11 and along the slope of the process unit 11. The transfer unit 12 includes a belt unit 20, and a secondary transfer roller 21.

The belt unit 20 is arranged to confront the photosensitive drums 18 from above. The belt unit 20 includes a drive roller 23, a first follow roller 24, a second follow roller 25, and an intermediate transfer belt 26.

The drive roller 23 is positioned obliquely above and forward of the front end of the process unit 11 (the handle 34).

The first follow roller 24 is positioned above and rearward of the drive roller 23 so that a line connecting the rotational centers of the drive roller 23 and the first follow roller 24 becomes parallel to the slope of the process unit 11.

The second follow roller 25 is disposed above and forward of the drive roller 23 such that a vertical gap is formed between the drive roller 23 and second follow roller 25. More specifically, the second follow roller 25 is positioned such that the line connecting the rotational centers of the drive roller 23 and second follow roller 25 slopes upward and forward.

The intermediate transfer belt 26 is placed around the drive roller 23, first follow roller 24, and second follow roller 25, with the lower portion of the intermediate transfer belt 26 positioned above the photosensitive drums 18 and contacting the same.

When the drive roller 23 is driven to rotate, the first follow roller 24 and second follow roller 25 follow the rotation of the drive roller 23 and the intermediate transfer belt 26 circulates such that the lower portion of the intermediate transfer belt 26 in contact with each of the photosensitive drums 18 moves in a forward direction.

The secondary transfer roller 21 is provided on the front side of the belt unit 20 and confronts the second follow roller 25 of the belt unit 20 with the intermediate transfer belt 26 interposed therebetween. More specifically, the secondary transfer roller 21 is rotatably supported in front-cover side walls 45 (described later) of the front cover 5. When the front cover 5 is in the closed position, the upper rear side surface of the secondary transfer roller 21 confronts the lower front side surface of the second follow roller 25.

(3-4) Fixing Unit

The fixing unit 13 is disposed above the secondary transfer roller 21. The fixing unit 13 includes a heating roller 28, and a pressure roller 29 that contacts and applies pressure to the lower side surface of the heating roller 28. The heating roller 28 and pressure roller 29 are both accommodated in a fixing-unit case 60.

(3-5) Paper-Guiding Section

The paper-guiding section 36 is provided in the front cover 5. When the front cover 5 is in the closed position, the paper-guiding section 36 is positioned in the front side of the main casing 2. The paper-guiding section 36 is integrally configured of a first conveying part 57, a secondary-transfer-roller accommodating part 37, and a second conveying part 58.

The first conveying part 57 is arranged between the feeding roller 10 and the secondary transfer roller 21 with respect to the vertical and is forward of the process unit 11. The first conveying part 57 has a generally flat surface that extends upward from the bottom edge of the front cover 5 (see FIGS. 1 and 2).

The secondary-transfer-roller accommodating part 37 is a recess formed in the paper-guiding section 36 and is recessed forward when the front cover 5 is in the closed position. The secondary-transfer-roller accommodating part 37 is generally U-shaped in a side view and formed continuously with the top edge of the first conveying part 57. The secondary transfer roller 21 is accommodated in the secondary-transfer-roller accommodating part 37.

Figure 2:
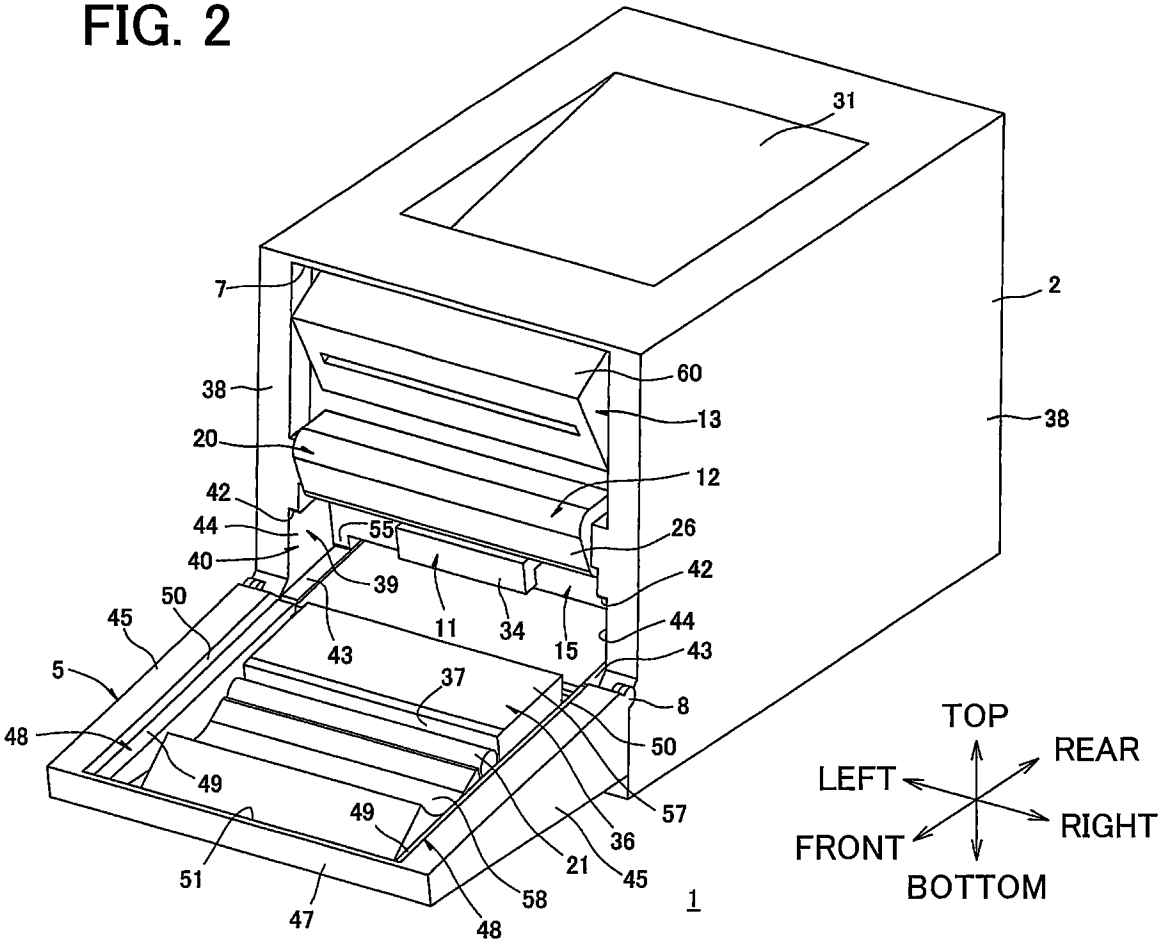
FIG. 2 is a cross-sectional view of the color printer according to the first embodiment of the present invention showing the process unit in the accommodated position.

The second conveying part 58 is a curved surface having its convex side facing forward when the front cover 5 is in the closed position (see FIGS. 1 and 2). The second conveying part 58 is positioned between the secondary transfer roller 21 and fixing unit 13 with respect to the vertical and extends upward from the top edge of the secondary-transfer-roller accommodating part 37.

(3-6) Image-Forming Operation (3-6-1) Developing Operation

Toner in each cartridge frame 17 is supplied onto a supply roller (not shown), and the supply roller in turn supplies the toner onto the corresponding developing roller (not shown).

In the meantime, the surfaces of the photosensitive drums 18 are exposed by laser beams emitted from the scanning unit 9. The laser beams form an electrostatic latent image on the surface of each photosensitive drum 18 corresponding to the image to be printed on paper P. As each photosensitive drum 18 rotates, the toner carried on the surface of the corresponding developing roller is supplied to the latent image formed on the surface of the photosensitive drum 18. The toner develops the latent image on the photosensitive drum 18 to a visible toner image through reverse development.

(3-6-2) Image Transferring and Fixing Operations

The toner images carried on the surfaces of the photosensitive drums 18 are sequentially transferred in a primary transfer onto the lower portion of the intermediate transfer belt 26, as the lower portion moves forward. The sequentially transferred toner images form a color toner image on the intermediate transfer belt 26.

The color image formed on the intermediate transfer belt 26 is subsequently transferred in a secondary transfer onto a sheet of paper P supplied from the sheet-feeding unit 3 and conveyed along the first conveying part 57 as the sheet passes through a nip point between the secondary transfer roller 21 and second follow roller 25.

Next, the sheet of paper P is conveyed along the second conveying part 58 into the fixing unit 13, and the color image transferred onto the sheet is fixed to the sheet by heat and pressure as the sheet passes between the heating roller 28 and pressure roller 29.

(4) Paper Discharge

After a color toner image is fixed to the sheet of paper P in the fixing unit 13, discharge rollers 30 disposed downstream of the fixing unit 13 convey the sheet out of the main casing 2 and onto a discharge tray 31 formed on the top surface of the main casing 2.

2. Detailed Description of the Main Casing (1) Accommodating Space

As shown in FIG. 2, the main casing 2 includes a pair of left and right main-casing side walls 38 for closing the left and right sides of the main casing 2. A guide groove 39 is formed in the inside surface of each main-casing side wall 38 for guiding the process unit 11 as the process unit 11 is mounted in and removed from the main casing 2. The guide grooves 39 are formed as depressions in the inside surfaces of the main-casing side walls 38 that are generally C-shaped in a front view. As shown in FIG. 1, the guide grooves 39 are formed to slope downward toward the front. The top and bottom surfaces of each guide groove 39 are defined respectively as an upper rail part 42 and a lower rail part 43, and the side surface of each guide groove 39 is defined as a side rail part 44.

The upper and lower rail parts 42 and 43 of each guide groove 39 are substantially parallel and oppose each other with a gap formed therebetween. The gap formed between the upper and lower rail parts 42 and 43 is substantially identical to the vertical dimension of the process frame 15. The left-to-right length (width) of the upper and lower rail parts 42 and 43 is substantially equivalent to the left-to-right dimension of the guided parts 55 provided on the process frame 15. The upper and lower rail parts 42 and 43 on each of the left and right sides are coupled at their rear ends. The front surface of this coupled portion is defined as a positioning surface 62.

The main-casing side walls 38 are arranged parallel to one another and are separated in the left-to-right direction so that the guide grooves 39 are aligned when projected in the left-to-right direction. The distance between the side rail parts 44 of the guide grooves 39 in the left-to-right direction is approximately equivalent to the left-to-right dimension of the process frame 15. The space formed in the main casing 2 between the guide grooves 39 of the main-casing side walls 38 is defined as an accommodating space 40 for accommodating the process unit 11.

(2) Front Cover

As shown in FIG. 2, the front cover 5 is pivotably (movably) mounted on the main casing 2 by two hinge parts 8 provided on the left and right ends of the front cover 5 on the bottom side thereof. The front cover 5 can pivot about the hinge parts 8 between an open position and a closed position. In the closed position, the front cover 5 is erect and substantially aligned with the vertical (see FIG. 1). In this state, the front cover 5 covers the access opening 7. In the open position, the top end of the front cover 5 lies downward so that the front cover 5 is substantially aligned with the front-to-rear direction (is horizontal). In this state, the access opening 7 is exposed.

The following description of the front cover 5 will be based on the front cover 5 in the open position shown in FIG. 2. Note that when the front cover 5 is in the open position, the proximal end on which the hinge parts 8 are provided is on the rear side, while the distal end is on the front side.

The front cover 5 has a frame-like structure with a closed bottom and is generally rectangular in a plan view. The front cover 5 is integrally configured of a pair of left and right front-cover side walls 45, a distal-end wall 47, and a bottom wall 46.

The front-cover side walls 45 have a generally trapezoidal shape in a side view, tapering from the proximal end toward the distal end. The front-cover side walls 45 are formed with substantial thickness in the left-to-right direction. A guiding part 48 is formed in each of the front-cover side walls 45.

The guiding parts 48 are notches formed one in the upper inside corner of each front-cover side wall 45 and are generally rectangular in a front view. Each guiding part 48 spans from the proximal end to the distal end of the front-cover side wall 45. The guiding part 48 includes a first guiding part 49, and a second guiding part 50.

The first guiding parts 49 are defined as the top surfaces in the notch-like guiding parts 48 formed in the upper inside corners of the corresponding front-cover side walls 45. Each first guiding part 49 is a generally flat surface that slopes downward toward the front. The left-to-right dimension (width) of the first guiding part 49 is substantially equivalent to the left-to-right dimension of the guided parts 55 provided on the process frame 15.

The second guiding parts 50 are defined as the side surfaces in the guiding parts 48. The second guiding parts 50 extend upward at right angles from the respective edges of the corresponding first guiding parts 49 nearest the outside of the respective front-cover side walls 45 with respect to the left-to-right direction. The dimension of the second guiding parts 50 along the direction orthogonal to the first guiding parts 49 (i.e., the height) is smaller than the length of the guided parts 55 in the direction that they protrude from the process frame 15.

The distal-end wall 47 has a generally flat strip-like shape and spans between the distal ends of the front-cover side walls 45. The rear surface of the distal-end wall 47 is defined as a restricting part 51. The distal-end wall 47 is arranged between the distal ends of the front-cover side walls 45 so that the restricting part 51 forms approximate right angles with the front-cover side walls 45.

The bottom wall 46 has a generally flat plate shape and connects to the bottom surfaces of the front-cover side walls 45 and the bottom edge of the distal-end wall 47 to close the bottom side of the front cover 5. The paper-guiding section 36 and secondary transfer roller 21 are provided in the bottom wall 46. Specifically, the first conveying part 57, secondary-transfer-roller accommodating part 37, and second conveying part 58 of the paper-guiding section 36 are arranged from the proximal end toward the distal end of the bottom wall 46. The secondary transfer roller 21 is rotatably supported in the front-cover side walls 45 and accommodated in the secondary-transfer-roller accommodating part 37 whose upper portion is opened.

The paper-guiding section 36 and the secondary transfer roller 21 are positioned lower than the top edges of the first guiding parts 49. Therefore, the process frame 15 will not come into contact with the paper-guiding section 36 and secondary transfer roller 21 when the process unit 11 is pulled out of the main casing 2, as will be described later.

When the front cover 5 is rotated to the open position shown in FIG. 2, the proximal end surfaces of the front-cover side walls 45 contact the front surface of the main casing 2. This contact restricts the front cover 5 from rotating any further and maintains the front cover 5 in the open position.

When the front cover 5 is in this open position, the first guiding parts 49 of the front-cover side walls 45 are oriented in substantially the same plane as the lower rail parts 43 of the main-casing side walls 38. In other words, the first guiding parts 49 and corresponding lower rail parts 43 form a continuous surface that slopes downward toward the front.

Additionally, the second guiding parts 50 of the front-cover side walls 45 are aligned in substantially the same vertical planes as the side rail parts 44 of the corresponding main-casing side walls 38.

When the front cover 5 is in the open position, the paper-guiding section 36 is exposed and faces upward, and the front sides of the process frame 15, belt unit 20, and fixing-unit case 60 of the fixing unit 13 are exposed through the access opening 7. Hence, when paper becomes jammed in the paper-guiding section 36, the jammed paper can be easily removed by simply opening the front cover 5.

3. Withdrawing the Process Unit from the Main Casing

Next, the operation for pulling the process unit 11 out of the main casing 2 will be described.

As shown in FIG. 1, the four process cartridges 16 supported in the process frame 15 are all accommodated in the main casing 2 when the process unit 11 is in an accommodated position accommodated in the accommodating space 40. In this state, the guided parts 55 of the process frame 15 are positioned on top of the corresponding lower rail parts 43, and the left and right side walls of the process frame 15 confront the side rail parts 44 of the corresponding guide grooves 39 in the left and right directions with a slight gap formed therebetween. Further, the rear surface of the process frame 15 is in contact with the positioning surface 62. In this state, the process unit 11 is accommodated in the accommodating space 40 of the main casing 2 and fixed in position relative to the main casing 2.

In order to pull the process unit 11 out of the accommodated position, first the operator places the front cover 5 in the open position to expose the access opening 7, as shown in FIG. 2. In this state, the accommodating space 40 is in communication with the exterior of the main casing 2 through the access opening 7. As described above, the first guiding parts 49 of the front-cover side walls 45 and the lower rail parts 43 of the corresponding main-casing side walls 38 are oriented along substantially the same plane sloping downward toward the front. The second guiding parts 50 of the front-cover side walls 45 are also oriented in substantially the same vertical planes as the side rail parts 44 of the corresponding main-casing side walls 38.

Figure 3:
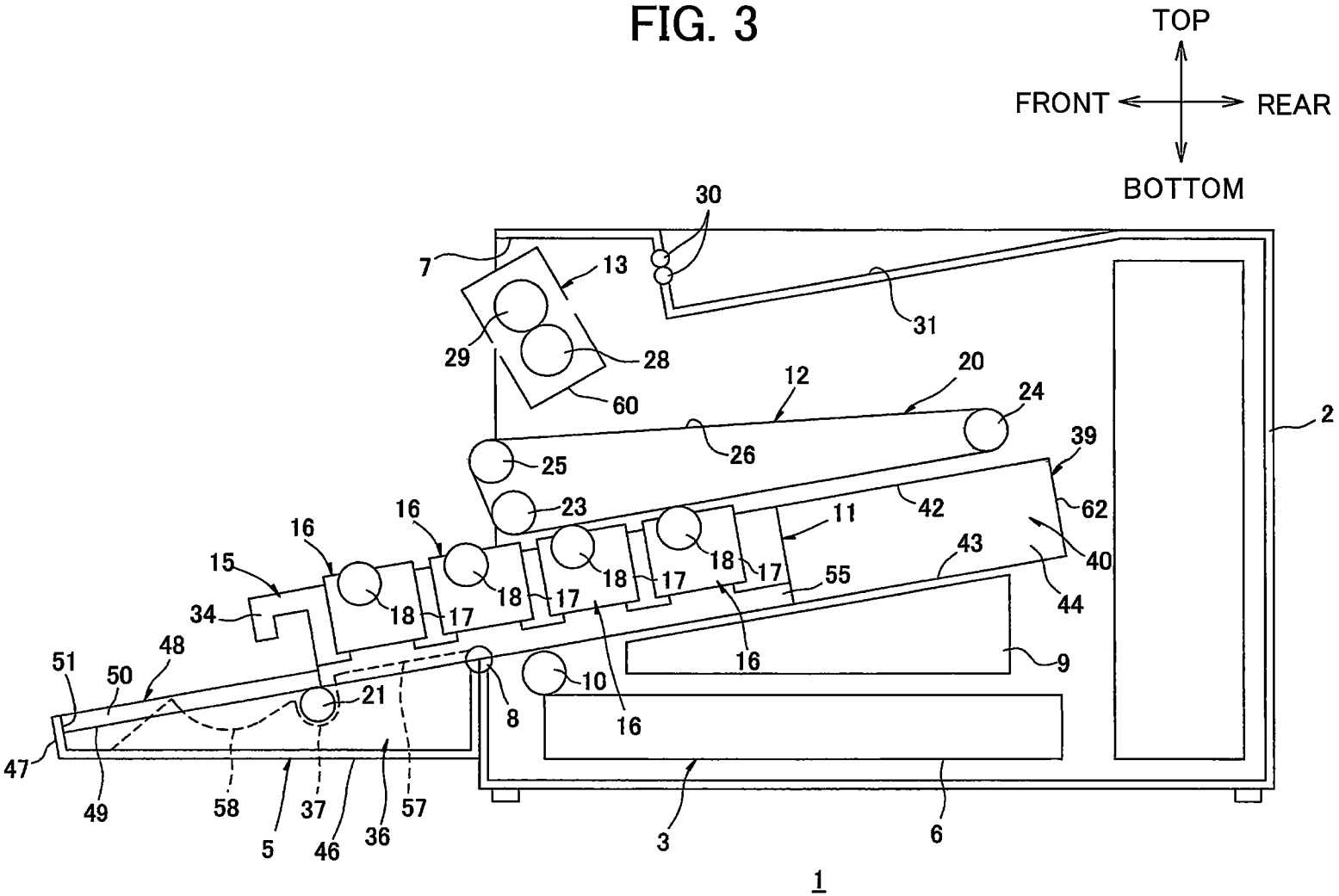
FIG. 3 is a cross-sectional view of the color printer according to the first embodiment of the present invention showing the process unit in a position midway between the accommodated position and withdrawn position.

Next, the operator grips the handle 34 on the process frame 15 and pulls the process unit 11 forward. As the process unit 11 moves forward, the guided parts 55 of the process frame 15 slide over the tops of the lower rail parts 43. As the process unit 11 continues to move forward and emerges from the accommodating space 40, as illustrated in FIG. 3, the guided parts 55 of the process unit 11 are guided along the first guiding parts 49 of the corresponding front-cover side walls 45. At this time, the first guiding parts 49 are positioned beneath the bottom surfaces of the corresponding guided parts 55. Consequently, the weight of the process unit 11 itself ensures that the bottom surfaces of the guided parts 55 contact the first guiding parts 49 and, hence, the guided parts 55 slides over the tops of the corresponding first guiding parts 49.

The left and right outer side surfaces of the corresponding guided parts 55 (i.e., both edges of the process frame 15 with respect to the direction orthogonal to the pulling direction of the process unit 11) are guided by the corresponding second guiding parts 50. In this way, the process unit 11 is restricted from moving left or right.

As the process unit 11 is pulled further forward, the front surfaces of the guided parts 55 contact the restricting part 51 from the rear side thereof, as shown in FIG. 4. The restricting part 51 restricts the process unit 11 from being pulled farther. At this point, the process unit 11 is in the withdrawn position. Hence, the restricting part 51 restricts the operator from moving the process unit 11 (the process frame 15) further downstream in the pulling direction than the withdrawn position. In this state, all four process cartridges 16 supported in the process frame 15 are exposed outside the main casing 2.

This completes the operation for pulling the process unit 11 from the accommodated position to the withdrawn position. The process unit 11 can be mounted in the main casing 2 by performing the same procedure described above in reverse.

4. Mounting and Removing the Process Cartridges Relative to the Process Unit

Figure 5:
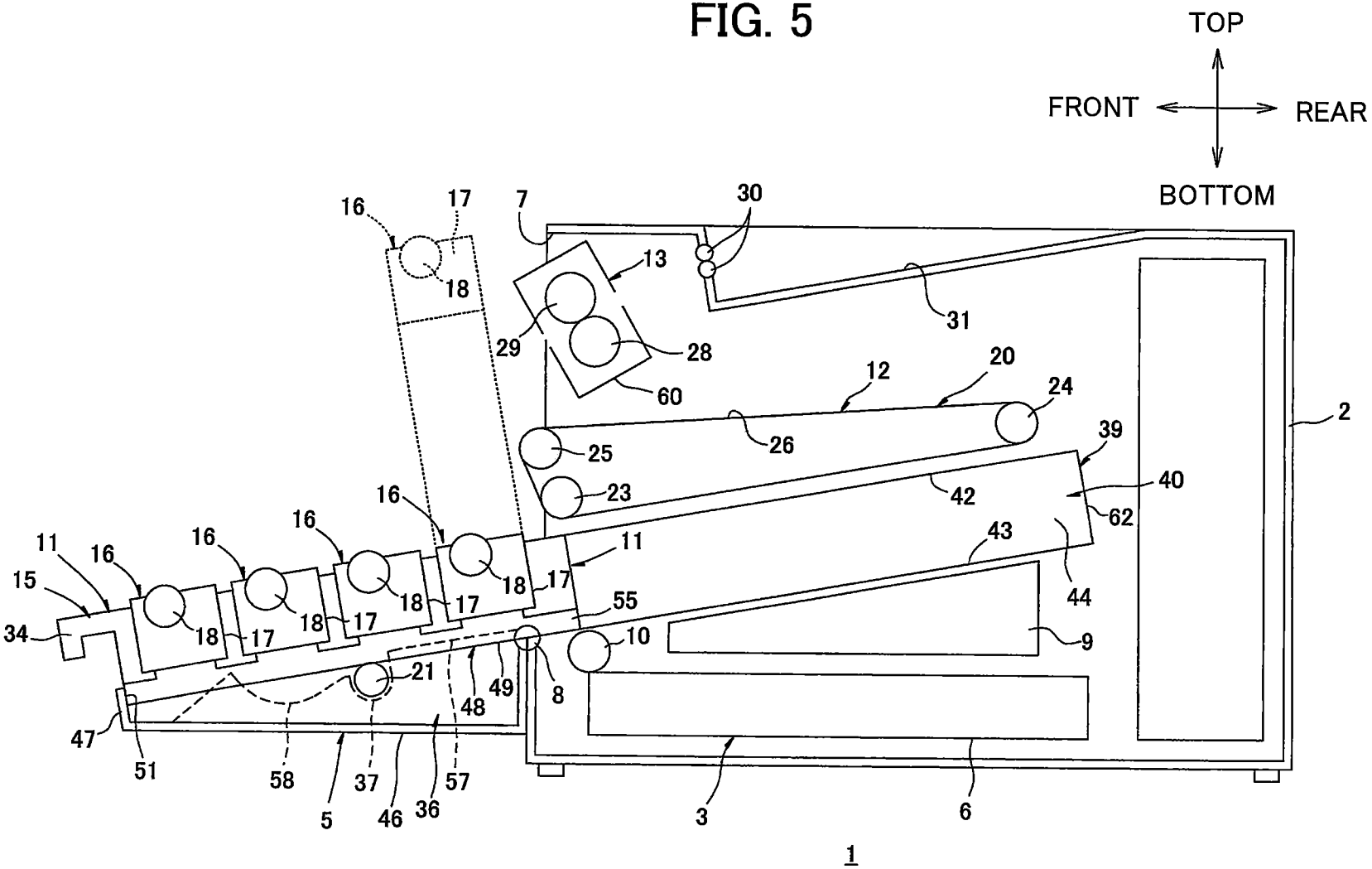
FIG. 5 is a cross-sectional view of the color printer according to the first embodiment of the present invention showing mounting/detaching of the process cartridge on/from the process unit.

After the process unit 11 has been pulled to the withdrawn position, as described above, the operator can remove the process cartridges 16 from the process frame 15 by pulling the process cartridges 16 upward and out through the top of the process frame 15, as illustrated by the dotted line in FIG. 5.

When mounting the process cartridges 16 in the process frame 15, the operator inserts the process cartridges 16 into the process frame 15 from above.

5. Operational Advantages (1) In the color printer 1 of the first embodiment described above, guiding parts 48 are formed in both front-cover side walls 45 of the front cover 5. More specifically, the guiding parts 48 are formed from the proximal end to the distal end of each front-cover side wall 45. That is, the guiding parts 48 formed in the front-cover side walls 45 extend from the upstream end in the pulling direction of the process frame 15 at which end the guided parts 55 are disposed when the process frame 15 is in the accommodated position, to the downstream end in the pulling direction of the process frame 15 at which end the guided parts 55 are disposed when the process frame 15 is in the withdrawn position.

This structure improves the stability of the process frame 15 during the process of pulling the process frame 15 from the accommodated position to the withdrawn position and while the process frame 15 is disposed in the withdrawn position, minimizing any play in the process frame 15. Therefore, through a simple construction, it is possible to facilitate operations of the color printer 1 when pulling the process frame 15 out of the main casing 2.

(2) When the front cover 5 is in the open position, the guiding parts 48 in both front-cover side walls 45 of the front cover 5 are positioned beneath the guided parts 55 of the process frame 15 when the process frame 15 is in the withdrawn position. Accordingly, the weight of the process unit 11 (the process frame 15) is sufficient for placing the bottom surfaces of the guided parts 55 in contact with the guiding parts 48. This structure can improve the stability of the process frame 15 and enables the process frame 15 to be pulled smoothly from the accommodated position to the withdrawn position.

When the process frame 15 is in the withdrawn position, the weight of the process unit 11 (the process frame 15) is entirely supported by the guiding parts 48. Hence, the process unit 11 (the process frame 15) can be supported stably in the withdrawn position and can thereby facilitate the operations for mounting the process cartridges 16 in and removing the process cartridges 16 from the process frame 15.

(3) Each of the guiding parts 48 has the first guiding part 49 defined as the top surface in the guiding part 48. The first guiding parts 49 are generally flat surfaces formed along a downward slope toward the front side. Hence, the first guiding parts 49 are formed to extend along the direction in which the process frame 15 is pulled. Through this simple structure, the first guiding parts 49 can reliably guide and support the process frame 15.

(4) Each of the guiding parts 48 also has the second guiding part 50 formed to extend upward at a right angle to the corresponding first guiding part 49 from the left or right outside edge thereof. Therefore, when the process frame 15 is pulled from the accommodated position to the withdrawn position, the second guiding parts 50 guide the left and right outer surfaces on the guided parts 55 of the process frame 15. Thus, the second guiding parts 50 restrict the process frame 15 from moving in the left and right directions.

Hence, this construction can reduce play in the process frame 15 in the direction orthogonal to the pulling direction of the process frame 15, thereby improving the ease of operations for pulling the process frame 15 out of the main casing 2.

(5) When the front cover 5 is in the open position, the distal-end wall 47 bridges the front ends of the front-cover side walls 45. The rear surface of the distal-end wall 47 is defined as the restricting part 51. When the process frame 15 is in the withdrawn position, the front surfaces on the guided parts 55 of the process frame 15 contact the restricting part 51. Hence, the restricting part 51 restricts the process frame 15 from moving downstream in the pulling direction farther than the withdrawn position.

Hence, this construction restricts the process frame 15 from being pulled further than necessary, thereby preventing the process frame 15 (the process unit 11) from falling off the front cover 5 as a result of the operator pulling the process frame 15 too far out of the main casing 2. Consequently, this construction can prevent the main casing 2 and process frame 15 from incurring damage by the process frame 15 being pulled too far out of the main casing 2.

(6) The guiding parts 48 are formed to slope downward toward the downstream side with respect to the pulling direction of the process frame 15 when the front cover 5 is in the open position. Accordingly, only a small amount of force is required to pull the process frame 15 (the process unit 11) out of the accommodated position.

Further, since the process frame 15 slopes downward toward the downstream side in the pulling direction (i.e., toward the user) when disposed in the withdrawn position, the process cartridges 16 supported in the process frame 15 can be easily removed and replaced. Thus, this construction improves the operability of the process frame 15 and facilitates maintenance of the color printer 1.

Second Embodiment

Next, a second embodiment of the present invention will be described.

Figure 6:
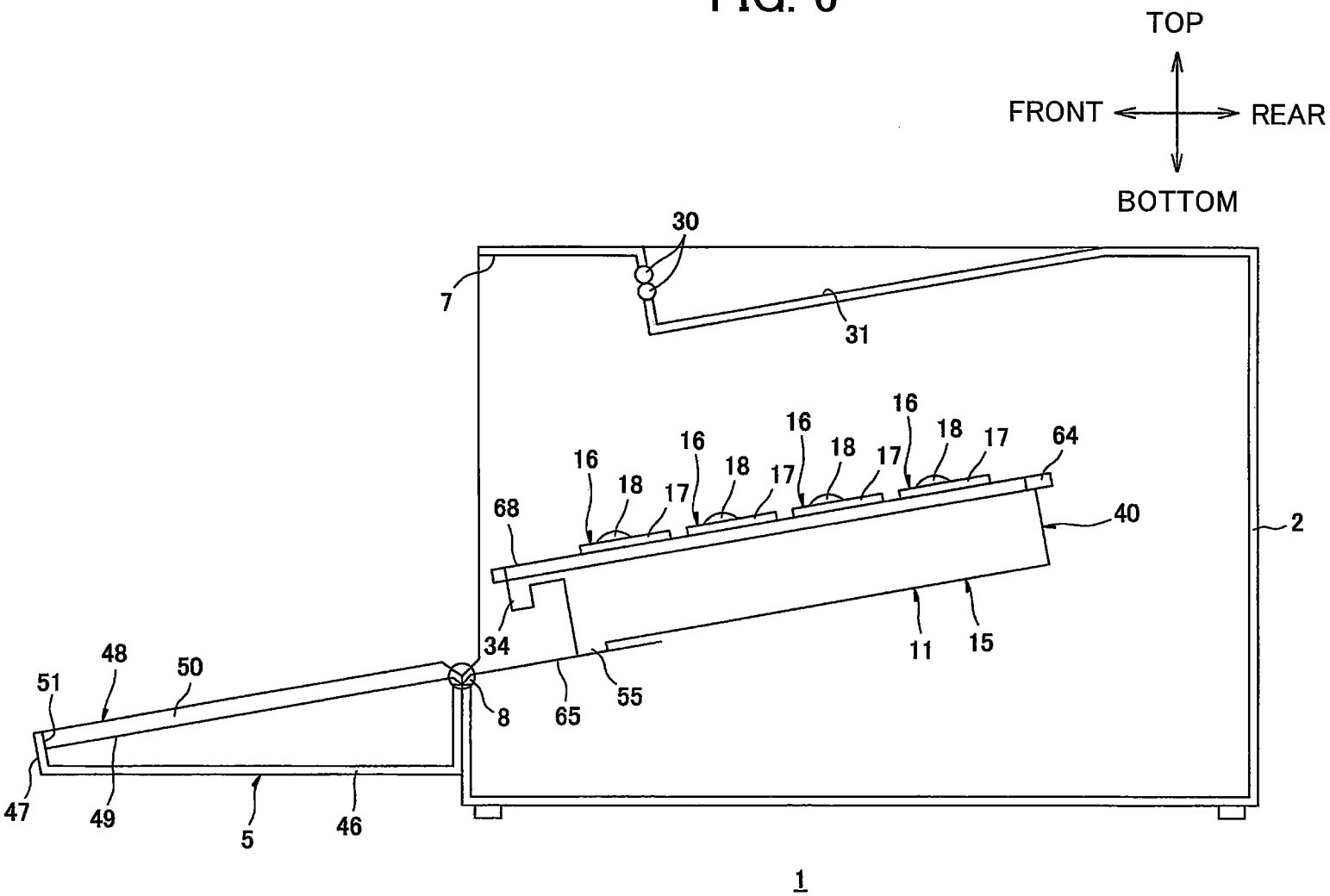
FIG. 6 is a cross-sectional view of the color printer according to a second embodiment of the present invention showing the process unit in the accommodated position.
Figure 7:
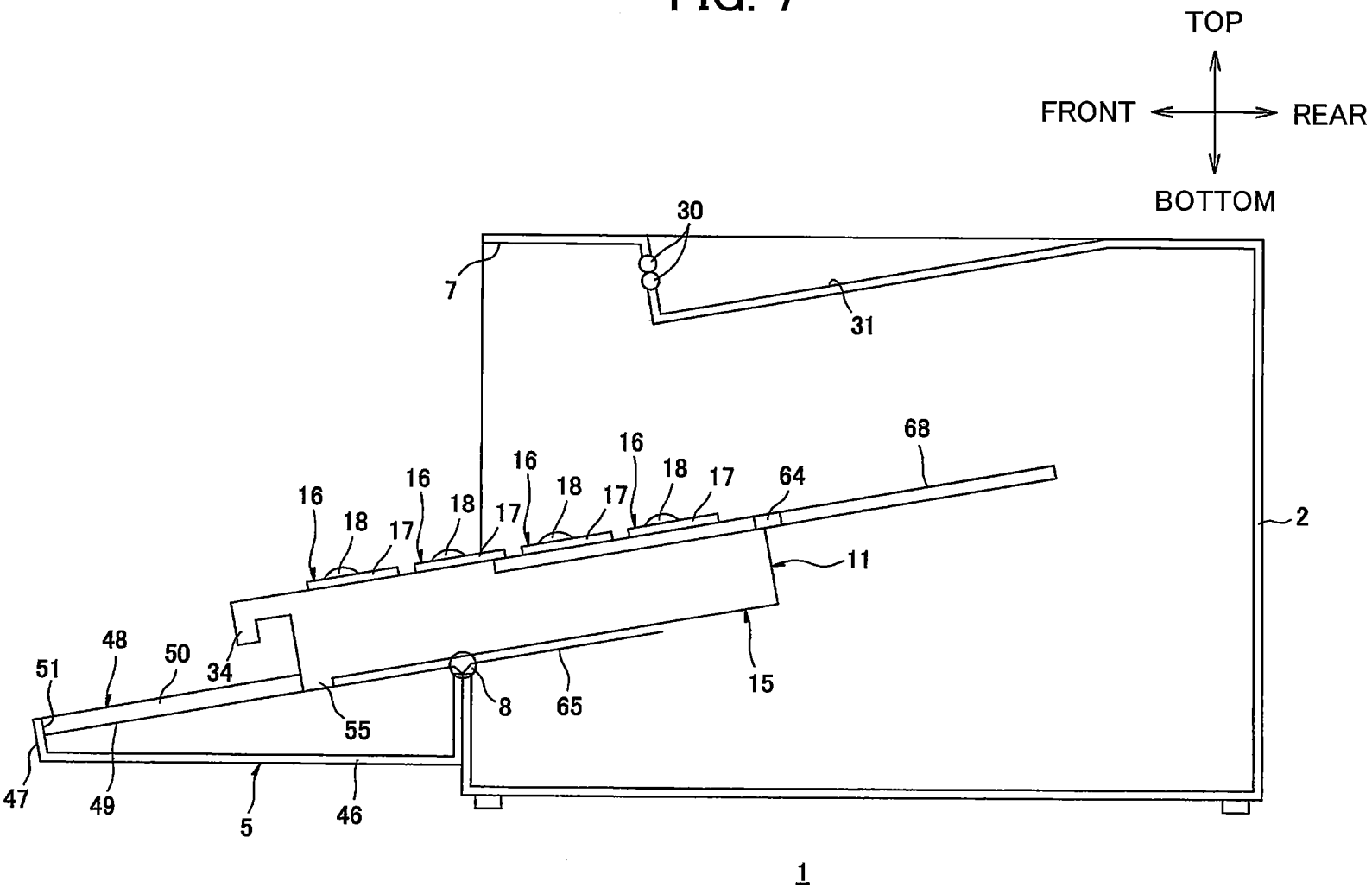
FIG. 7 is a cross-sectional view of the color printer according to the second embodiment of the present invention showing the process unit in a position midway between the accommodated position and withdrawn position.
Figure 8:
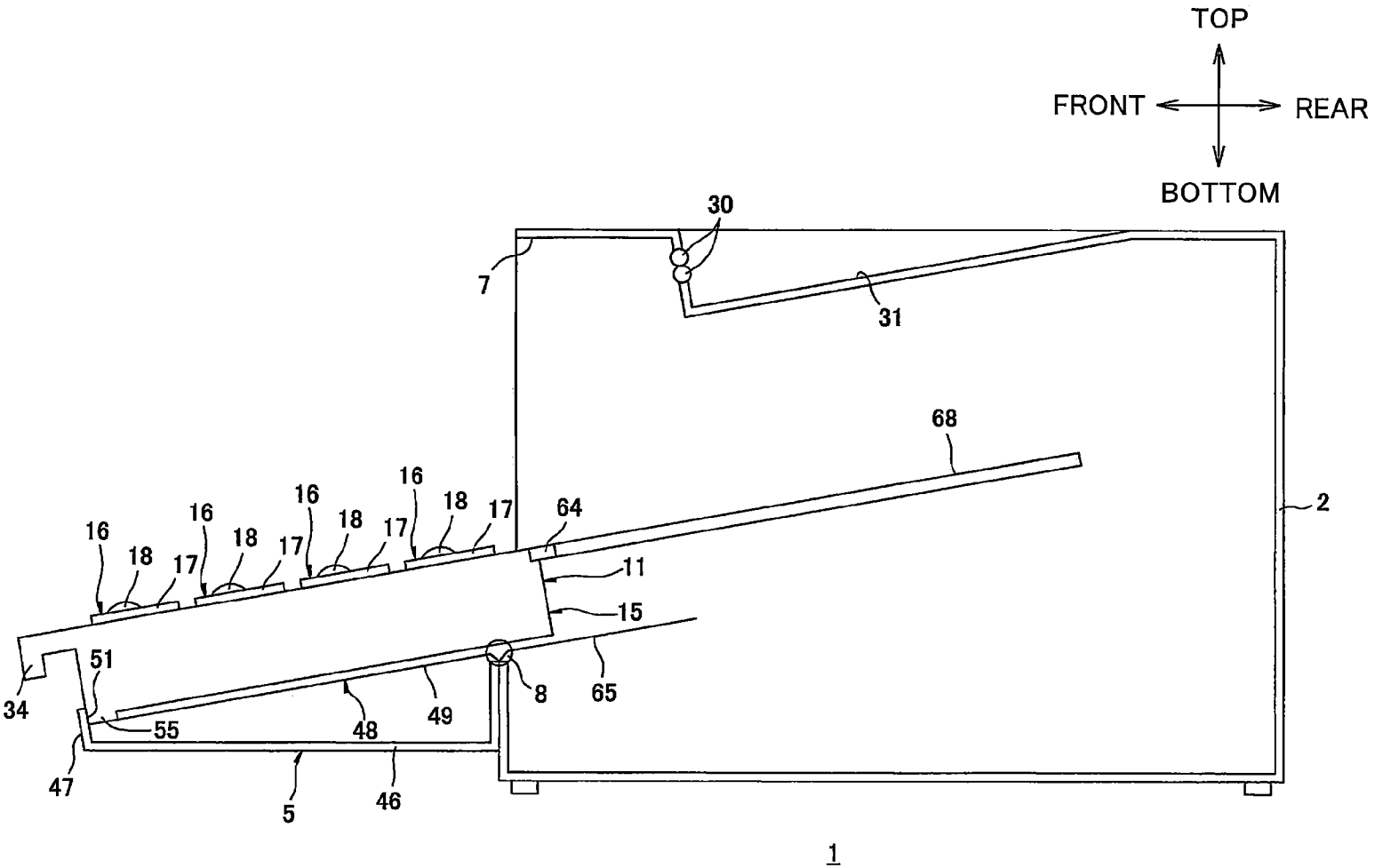
FIG. 8 is a cross-sectional view of the color printer according to the second embodiment of the present invention showing the process unit in the withdrawn position.

FIG. 6 is a cross-sectional view of the color printer according to the second embodiment in which the front cover is open and the process unit is in the accommodated position. FIG. 7 is a cross-sectional view of the color printer showing the process unit in a position midway between the accommodated position and withdrawn position. FIG. 8 is a cross-sectional view of the color printer showing the process unit in the withdrawn position. FIGS. 6, 7, and 8 are explanatory diagrams for illustrating how the process unit in the color printer of the second embodiment is pulled out of the main casing. In FIGS. 6, 7, and 8, parts and components corresponding to those shown in FIGS. 1 through 5 of the first embodiment are designated with the same reference numerals to avoid duplicating description.

(1) Process Frame

In the color printer 1 according to the first embodiment shown in FIG. 1, the guided parts 55 are formed on the bottom surface of the process frame 15 along both left and right edges and extend in the front-to-rear direction. In the color printer 1 according to the second embodiment shown in FIG. 6, the guided parts 55 are also formed on the bottom surface of the 15 on both left and right edges thereof. In contrast to the first embodiment, however, the guided parts 55 are only formed on the front end of the process frame 15.

The process frame 15 also includes engaging parts 64. The engaging parts 64 are generally rectangular in a side view and are formed on the upper rear edges of the process frame 15. Specifically, one of the engaging parts 64 is formed on each of the left and right side walls of the process frame 15 and protrudes outward with respect to the left-to-right direction. The rear half of each engaging part 64 protrudes rearward from the rear end of the process frame 15.

(2) Main Casing

The accommodating space 40 for accommodating the process unit 11 is defined inside the main casing 2, as shown in FIG. 6. Within the accommodating space 40, a guide groove 68 is formed in the inside surfaces of each main-casing side wall 38. The guide grooves 68 are elongated grooves formed as depressions in the inside surfaces of the main-casing side walls 38. The guide grooves 68 are formed so as to slope downward toward the front.

Main-casing-side guiding parts 65 are provided in the main casing 2. The main-casing-side guiding parts 65 are generally flat surfaces that protrude inward in respective left and right directions from the right and left inside surfaces of the main-casing side walls 38. Each of the main-casing-side guiding parts 65 has a length in the left-to-right direction (width) substantially identical to the left-to-right dimension of the guided parts 55 provided on the process frame 15.

Each of the main-casing-side guiding parts 65 is formed to extend along a downward and forward slope from front-to-rear midpoints of the main-casing side walls 38 to the front edges of the corresponding main-casing side walls 38. The main-casing-side guiding parts 65 are generally parallel to the front portions of the corresponding guide grooves 68 and face the same with a gap formed therebetween. The gap formed between the main-casing-side guiding parts 65 and the opposing front portions of the guide grooves 68 is substantially identical to the vertical dimension of the process frame 15.

When the process frame 15 is in the accommodated position, the engaging parts 64 are engaged in the corresponding guide grooves 68 and the guided parts 55 are resting on the top surfaces of the corresponding main-casing-side guiding parts 65. Further, the rear surfaces of the engaging parts 64 contact the rear ends defining the guide grooves 68, thereby positioning the process unit 11 relative to the main casing 2.

(3) Withdrawing the Process Unit from the Main Casing

In order to pull the process unit 11 out from the accommodating space 40 formed in the main casing 2, first the operator places the front cover 5 in the open position to expose the access opening 7, as shown in FIG. 6.

At this time, the main-casing-side guiding parts 65 of the main-casing side walls 38 and the first guiding parts 49 of the front-cover side walls 45 are aligned in substantially the same plane sloping downward toward the front. Further, the inside surface of each main-casing side wall 38 and the corresponding second guiding part 50 formed in the front-cover side wall 45 are aligned in substantially the same vertical plane.

Next, the operator grips the handle 34 of the process frame 15 and pulls the process unit 11 forward. As the process unit 11 moves forward, the engaging parts 64 of the process frame 15 slide within the corresponding guide grooves 68 and the guided parts 55 formed on the process frame 15 slide over the tops of the corresponding main-casing-side guiding parts 65.

As the process unit 11 continues to move forward and is pulled out from the accommodating space 40, as illustrated in FIG. 7, the guided parts 55 of the process unit 11 leave the main-casing-side guiding parts 65 and are guided along the first guiding parts 49 of the front-cover side walls 45. At the same time, the outer left and right surfaces of the respective guided parts 55 are guided by the corresponding second guiding parts 50.

Next, the front surfaces of the guided parts 55 contact the restricting part 51 from the rear side thereof, as illustrated in FIG. 8. This contact restricts the operator from pulling the process unit 11 further in the pulling direction. In this state, the process unit 11 is in the withdrawn position. This completes the operation to pull the process unit 11 from the accommodated position to the withdrawn position.

(4) Operational Advantages

The color printer 1 according to the second embodiment described above can obtain the same operational advantages described in the first embodiment.

7. Variations of the Embodiments

In the color printer 1 described above in the preferred embodiments, the first guiding parts 49 and second guiding parts 50 are generally flat surfaces formed continuously from the proximal ends to the distal ends of the respective front-cover side walls 45, but the first guiding parts 49 and second guiding parts 50 are not limited to these configurations, provided that the first guiding parts 49 and second guiding parts 50 are capable of guiding the guided parts 55 of the process frame 15.

For example, the first guiding parts 49 and second guiding parts 50 may have recessed parts or the like depressed downward at a midway point along the front-cover side walls 45 between the proximal and distal ends thereof, rather than being continuously flat.

What is claimed is:

1. An image-forming device comprising:

a main casing defining an accommodating space therein, and formed with an access opening communicating the accommodating space with an exterior;

an open/close member provided at the main casing to move between an open position for opening the access opening and a closed position for closing the access opening, the open/close member positioned in the open position extending in a direction; and a drawer member configured to support a plurality of cartridges and be movable from an accommodated position to a withdrawn position along the open/close member positioned in the open position, the plurality of cartridges being accommodated in the accommodating space when the drawer member is positioned in the accommodated position, the plurality of cartridges being exposed from the main casing when the drawer member is positioned in the withdrawn position, wherein the open/close member positioned in the open position has a length in the direction, a guiding part being formed at the open/close member over the length to guide the drawer member to the withdrawn position, and wherein the guiding part is sloped downward when the open/close member is positioned in the open position.

2. The image-forming device according to claim 1, wherein the open/close member positioned in the open position is positioned beneath the drawer member positioned in the withdrawn position.

3. The image-forming device according to claim 2, wherein the guiding part has a first guiding part formed on the open/close member positioned in the open position and extending in the direction.

4. The image-forming device according to claim 3, wherein the open/close member has both edges extending in the direction, and the guiding part further has a pair of second guiding parts to guide both edges.

5. The image-forming device according to claim 1, wherein the open/close member includes a restricting part configured to restrict the drawer member from moving to a position downstream of a drawer position in the direction.

6. An image-forming device comprising:

a main casing defining an accommodating space therein, and formed with an access opening communicating the accommodating space with an exterior;

an open/close member provided at the main casing to move between an open position for opening the access opening and a closed position for closing the access opening, the open/close member positioned in the open position extending in a direction; and a drawer member configured to support a plurality of cartridges and be movable from an accommodated position to a withdrawn position along the open/close member positioned in the open position, the plurality of cartridges being accommodated in the accommodating space when the drawer member is positioned in the accommodated position, the plurality of cartridges being exposed from the main casing when the drawer member is positioned in the withdrawn position, wherein the open/close member positioned in the open position has a length in the direction, a guiding part being formed at the open/close member over the length to guide the drawer member to the withdrawn position, and wherein the open/close member includes a restricting part configured to restrict the drawer member from moving to a position downstream of a drawer position in the direction.

7. The image-forming device according to claim 6, wherein the open/close member positioned in the open position is positioned beneath the drawer member positioned in the withdrawn position.

8. The image-forming device according to claim 7, wherein the guiding part has a first guiding part formed on the open/close member positioned in the open position and extending in the direction.

9. The image-forming device according to claim 8, wherein the open/close member has both edges extending in the direction, and the guiding part further has a pair of second guiding parts to guide both edges.

10. An image-forming device comprising:

a main casing defining an accommodating space therein, and formed with an access opening communicating the accommodating space with an exterior;

an open/close member provided at the main casing to move between an open position for opening the access opening and a closed position for closing the access opening, the open/close member positioned in the open position extending in a direction; and a drawer member configured to support a plurality of cartridges and be movable from an accommodated position to a withdrawn position along the open/close member positioned in the open position, the plurality of cartridges being accommodated in the accommodating space when the drawer member is positioned in the accommodated position, the plurality of cartridges being exposed from the main casing when the drawer member is positioned in the withdrawn position, wherein the open/close member positioned in the open position has a length in the direction, a guiding part being formed at the open/close member over the length to guide the drawer member to the withdrawn position, wherein the open/close member positioned in the open position is positioned beneath the drawer member positioned in the withdrawn position, wherein the guiding part has a first guiding part formed on the open/close member positioned in the open position and extending in the direction, and wherein the open/close member has both edges extending in the direction, and the guiding part further has a pair of second guiding parts to guide the both edges.

* * * * *